US005161390A

United States Patent [19]

Sam

[11] Patent Number: 5,161,390

[45] Date of Patent: Nov. 10, 1992

[54] INTERCHANGEABLE AND DETACHABLE EARRING ASSEMBLAGE

[76] Inventor: Mina Sam, 671 Forest Ave., Paramus, N.J. 07652

[21] Appl. No.: 737,773

[22] Filed: Jul. 30, 1991

[51] Int. Cl.[5] ..... A44L 7/00

[52] U.S. Cl. ..... 63/12; 63/13

[58] Field of Search ..... 63/12, 13, 14.1, 29.1, 63/1.1, 2

[56] References Cited

U.S. PATENT DOCUMENTS

| | | | |
|---|---|---|---|
| 292,810 | 2/1884 | Hartmann | 63/12 |
| 4,086,786 | 5/1978 | Ritter | 63/13 |
| 4,725,511 | 2/1988 | Reber | 63/12 |
| 4,763,489 | 8/1988 | Strong | 63/13 |
| 4,783,974 | 11/1988 | Hernandez | 63/12 |
| 4,803,852 | 2/1989 | Waldron | 63/13 |
| 4,869,078 | 9/1989 | Leith | 63/13 |

FOREIGN PATENT DOCUMENTS

| | | | |
|---|---|---|---|
| 812568 | 4/1959 | United Kingdom | 63/2 |
| 859188 | 1/1961 | United Kingdom | 63/29.1 |

OTHER PUBLICATIONS

*Jeweller' Circular-Keystone* p. 91 Aug. 1989.

*Primary Examiner*—Renee S. Luebke
*Assistant Examiner*—F. Saether

[57] ABSTRACT

There is disclosed a decorative interchangeable and detachable earring assemblage comprising individual and separable earring units which can all be of the same size and shape or of different sizes and shapes enabling the earring units to be mixed or matched depending on the fashion mood of the wearer.

10 Claims, 1 Drawing Sheet

FIG-1
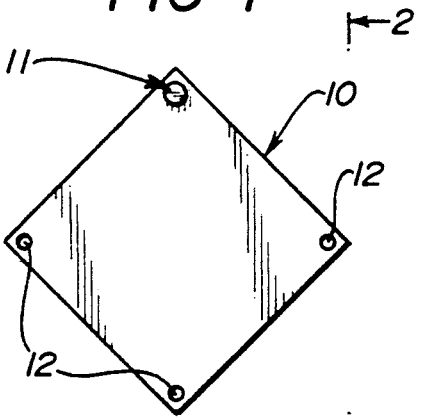
FIG-2
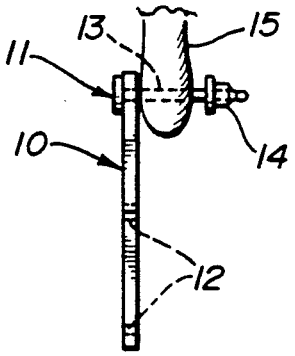
FIG-3
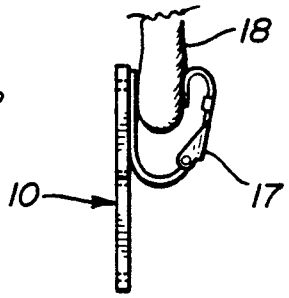
FIG-4
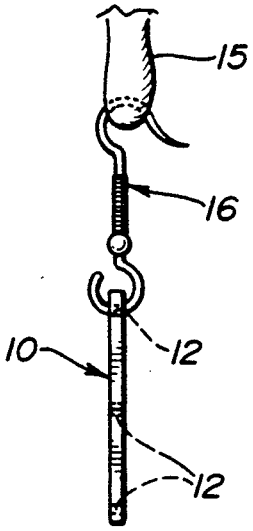
FIG-5
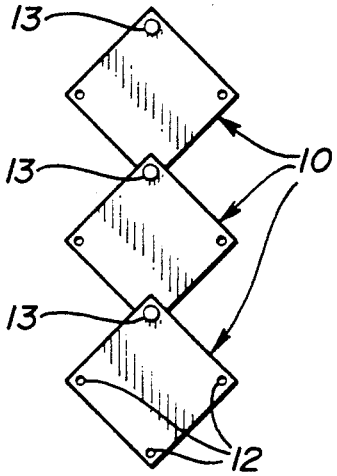
FIG-6
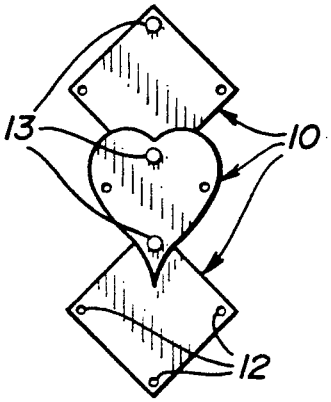
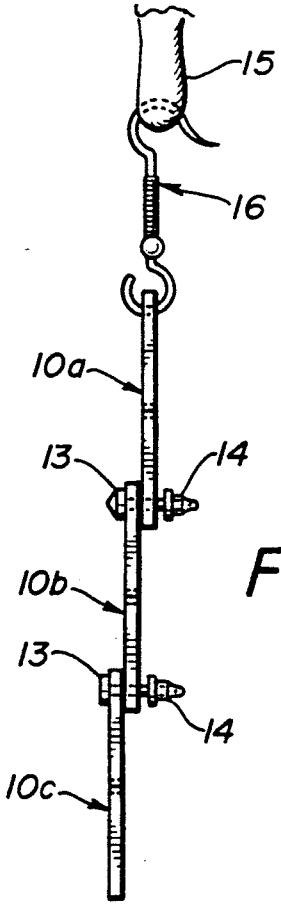
FIG-7

INTERCHANGEABLE AND DETACHABLE EARRING ASSEMBLAGE

BACKGROUND OF THE INVENTION

This invention is directed toward an interchangeable and detachable earring assemblage comprising individual and separable earring units which can all be of the same size and shape or of different sizes and shapes enabling the earring units to be mixed or matched depending on the fashion mood of the wearer.

The interchangeable and detachable earring assemblage of the invention is of the type generally referred to as modular jewelry. Typically, such modular jewelry comprises elements of various shapes, sizes and configurations which permits the user to pre-select desired elements for wear. In addition to being aesthetic and functional, such elements should also be easy to assemble and comfortable to wear.

Prior attempts to provide modular jewelry, particularly modular earring units, have been limiting in that the wearer has been confined to assembling elements that are either all of the same shape, size and configuration, or are difficult to assemble, or are uncomfortable to wear.

SUMMARY OF THE INVENTION

The interchangeable and detachable earring assemblage of the invention generally comprises individual and separable earring units each of which has a removable, active attachment means and at least one passive attachment means formed integrally within the perimeters of the units such that the active attachment means in one unit can be secured to and carried by a passive attachment means in the same unit and a second active attachment means can be threaded through and carried by a passive attachment means in another of said units enabling a plurality of said earring units to be interconnected to form said earring assemblage.

The removable, active attachment means employed can be of the type conventionally used to attach earrings to the ear lobe of a wearer such as an earring post or an earring hook where the ear lobe of the wearer has been pierced to accept such attachment means.

The passive attachment means comprises at least one aperture integrally formed within the perimeter of the earring units and sized to receive an active attachment means therethrough. When two passive attachment apertures are provided, they are preferably positioned diametrically opposite one another so that a removable, active attachment means can be threaded through and carried by each of the passive attachment means.

In assembly, a removable, active attachment means (e.g., an earring post or an earring hook) is secured to and carried by a passive attachment aperture means and this active attachment means can then be later affixed to the pierced ear lobe of the wearer. A second removable, active attachment means is then threaded through and carried by another passive attachment aperture in the same earring unit and also threaded through and secured to a passive attachment aperture in another earring unit to thus interconnect two or more earring units to each other. In this way, the wearer can assemble as many earring units together as desired.

Where a wearer does not have pierced ear lobes, the initial earring unit to be secured to the wearer's ear lobe can be provided with conventional clip-on attachment means while the remaining earring units are provided with the active attachment means and the passive attachment apertures described above.

The individual and detachable earring units that can be employed can be of any size and of any shape such as square, rectangular, triangular, oblong, circular, diamond, and the like, as well as free-form configurations. Where one or more of the earring units is of a free-form configuration, a plurality of passive attachment apertures are preferably integrally formed within the perimeters of the free-form units to offer the wearer a greater assemblage selection.

DETAILED DESCRIPTION OF THE INVENTION

The detachable and interchangeable jewelry earring assemblage of the invention will become more apparent from the ensuing description when considered together with the accompanying drawing wherein like reference numerals denote like parts and wherein:

FIG. 1 is an elevation view illustrating one type of decorative earring unit of the invention;

FIG. 2 is a view taken substantially on line 2—2 of FIG. 1 illustrating a post type attachment means that can be used with the decorative earring units of the invention;

FIG. 3 is a view similar to that of FIG. 2 illustrating a clip-on attachment means that can be used for securing the decorative earring units of the invention to non-pierced ear lobes;

FIG. 4 is also a view similar to that of FIG. 2 illustrating a hook type attachment means that can be used with the decorative earring units of the invention;

FIG. 5 is a front elevation view illustrating an earring assemblage of the invention using post type attachment means to interconnect a plurality of earring units to one another;

FIG. 6 is a front elevation view illustrating another earring assemblage of the invention where the detachable earring units are of a different size and shape; and, FIG. 7 is a side elevation view illustrating a plurality of decorative earring units of the invention interconnected to each other using a combination of hook/post type attachment means.

Turning now to the drawing, there is shown in FIGS. 1 and 2 one embodiment of a decorative, detachable earring unit of the invention 10 having a diamond shaped configuration which is provided with a removable, active attachment means 11 and which contains a plurality of passive attachment means 12. The active attachment means 11 comprises a post 13 and mating back piece 14 which are used to secure earring unit 10 to a pierced ear lobe, indicated by reference numeral 15, in a typical manner. Passive attachment means 12 comprise a plurality of apertures formed in and contained within the perimeter of the earring unit 10. Passive attachment means 12 serve to receive the removable, active attachment means and are positioned within the perimeter of earring unit 10 in spaced apart relationship to each other. In the embodiments illustrated, a plurality of passive attachment means 12 are shown, but at least two such means should be provided in each earring unit and are preferably positioned diametrically opposite to each other.

In the embodiment shown in FIG. 4, the removable, active attachment means comprises a typical earring hook 16, one end portion of which is threaded through a passive attachment means 12 while the other end is carried by a pierced ear lobe 15.

For those persons who do not have pierced ear lobes, an earring unit 10 can be equipped with a typical spring clip 17 as shown in FIG. 3 to secure the initial earring unit to an unpierced ear lobe 18. Additional earring units 10 can then be secured to this initial earring unit to create an earring assemblage as desired by the wearer.

To assemble the earring units 10, the removable, active attachment means of one earring unit is threaded through and carried by the passive attachment means of another earring unit as illustrated in FIGS. 5 and 7. As shown in FIG. 5, post 13 and back piece 14 (not visible) are used to interconnect earring units 10 to form an earring assemblage whereas in FIG. 7, an earring hook 16 is employed to attach the initial earring unit 10*a* to a pierced ear lobe 15 while posts 13 and back pieces 14 are used to interconnect a plurality of earring units 10*b*, 10*c*, to create an earring assemblage.

Where desired, earring units having different geometric configurations can be joined together, such as by using earring posts 13 and back pieces as illustrated in FIG. 6; to create an earring assemblage reflecting the fashion mood of the wearer.

While the earring assemblage of the invention has been described in some detail and with particularity, it should be understood that changes and modifications can be made therein without departing from the scope of the invention recited in the claims.

What is claimed is:

1. An interchangeable and detachable earring assemblage comprising:

a plurality of individual and separable earring units, each of said earring units having at least one removable, active attachment means associated therewith and at least one passive aperture attachment means formed integrally within the perimeter of each of said units such that an active attachment means in a first of said units is secured to and carried by a passive attachment means in the same unit and a second active attachment means can be threaded through and carried by the passive attachment means of another of said units simultaneously threaded through a passive attachment means of said first unit enabling a plurality of said earring units to be interconnected to form said earring assemblage.

2. The earring assemblage of claim 1 wherein said removable, active attachment means is an earring post capable of being received by a pierced ear lobe.

3. The earring assemblage of claim 1 wherein said removable, active attachment means is an earring hook capable of being received by a pierced ear lobe.

4. The earring assemblage of claim 1 wherein said active attachment means is a spring clip unit capable of being secured to an unpierced ear lobe.

5. The earring assemblage of claim 1 wherein said passive attachment means comprises a plurality of apertures integrally formed and contained within the perimeter of each of said earring units.

6. The earring assemblage of claim 5 wherein at least one of said passive attachment means is positioned diametrically opposite to said active attachment means.

7. An interchangeable and detachable earring assemblage comprising:

a plurality of individual and separable earring units, each of said earring units having at least one removable, active attachment means associated therewith and passive attachment means comprising a plurality of apertures integrally formed and contained within the perimeter of each of said earring units, at least one of said passive attachment means being positioned diametrically opposite to said active attachment means such that one of said active attachment means in a first of said units is secured to and carried by a passive attachment means in the same unit and a second active attachment means can be threaded through and carried by the passive attachment means of another of said units simultaneously threaded through a passive attachment means of said first unit enabling a plurality of said earring units to be interconnected to form said earring assemblage.

8. The earring assemblage of claim 7 wherein said removable, active attachment means is an earring post capable of being received by a pierced ear lobe.

9. The earring assemblage of claim 7 wherein said removable, active attachment means is an earring hook capable of being received by a pierced ear lobe.

10. The earring assemblage of claim 7 wherein said active attachment means is a spring clip unit capable of being secured to an unpierced ear lobe.

* * * * *